United States Patent [19]

Portal

[11] 3,940,087

[45] Feb. 24, 1976

[54] SPOOL

[76] Inventor: Pierre Portal, Haute Marne 52, Bologne, France

[22] Filed: Jan. 21, 1974

[21] Appl. No.: 435,285

[30] Foreign Application Priority Data

Jan. 24, 1973 France ..... 73.02550

[52] U.S. Cl. ..... 242/118.62

[51] Int. Cl.[2] ..... B65H 75/14

[58] Field of Search..... 242/118.62, 118.5, 118.61, 242/118.4, 118.7, 77.3

[56] References Cited

UNITED STATES PATENTS

| | | | |
|---|---|---|---|
| 2,237,837 | 4/1941 | Markle, Jr. | 242/118.62 |
| 2,626,113 | 1/1953 | Miller | 242/118.62 |
| 2,683,573 | 7/1954 | Cary | 242/118.62 |
| 2,837,297 | 6/1958 | Moss | 242/118.62 |
| 3,099,417 | 7/1963 | Portal | 242/118.62 |

*Primary Examiner*—Leonard D. Christian

*Attorney, Agent, or Firm*—Weiser, Stapler & Spivak

[57] ABSTRACT

A spool or warp beam for warp threads comprising an elongated tubular drum having circular steel brackets threadedly connected at the ends. The brackets are outwardly formed to provide a peripherally threaded section. A light alloy flange is provided with a circular cavity having a threaded periphery which turns upon the peripherally threaded section to interconnect the flange and bracket. The diameters of the threaded section and the cavity are designed to provide a shrink fit upon assembly. The coefficients of expansion of the bracket and flange materials are chosen to neutralize the shrinkage effect upon elevating the temperature of the assembly approximately 100° centigrade.

6 Claims, 1 Drawing Figure

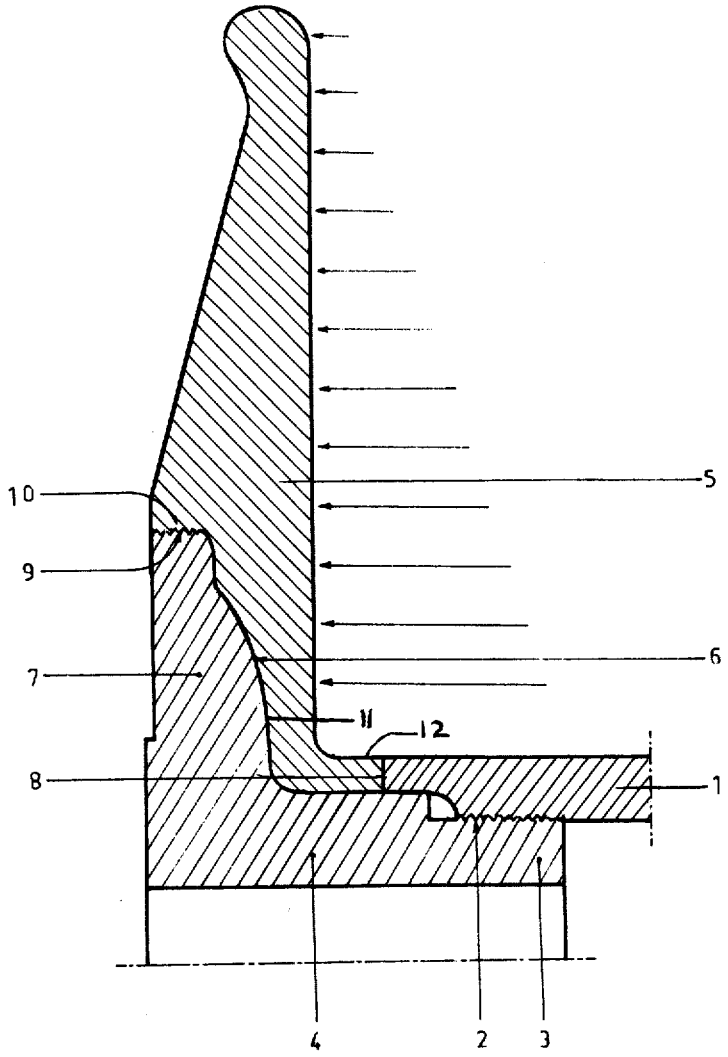
10
9
7
8
5
6
11
12
1
4
2
3

SPOOL

BACKGROUND OF THE INVENTION

The invention relates in general to a spool, and more particularly, is directed to a spool or warp beam used in the textile industry.

Such spools onto which threads are warped are already known, being used in conventional knitting looms. The prior art spools or warp beams generally consist of cylindrical drums which are fitted to two annular, lateral flanges by means of brackets. The brackets are usually each provided with a screw threaded portion which is screwed onto the threaded part at the two ends of the drum.

Since these spools are subjected to considerable deformation and fatigue stress on account of radial and horizontal forces of the tension components of the warped threads, consideration was given to making the spools or warp beams of two different materials with two different moduli of elasticity. In this manner, they should be able to better withstand the tensions of the warped threads and that the deformation, particularly that of the flanges, should be reduced to a minimum. It will be noted that the thread makes contact with the flanges which are made of light alloy, having a modulus of elasticity of, for example, 7,000. These light alloy flanges are supported by steel brackets, made of steel with a modulus of elasticity of 24,000, which appreciably reduces the deformations of the flanges inversely proportionally to the modulus.

Although this type of design insures resistance against fatigue generated by the tensions resulting from the load of the thread, that is to say, that although it takes the mechanical deformations of the loaded spools into account, it does not take into consideration other deformations, which are just as serious, which can be caused by shocks received during handling of empty or loaded spools. Thus, it will be realized that during use, the outer portions of the spools are frequently damaged as a result of falls or blows, which results in their deformation in a direction opposite to that of the load from a horizontal stress directed outwardly. Blows from outside result in the flanges being pinched, which leads to their buckling or removal from the steel bracket. This buckling of the flange with respect to the axis of the drum of the spool is a primary reason for taking the spool out of service, as otherwise, the buckling would lead to the rupture or the untimely displacement of the warp threads located on the warp beam, in parallel, sided by side relation, according to the place they will occupy in the cloth.

SUMMARY OF THE INVENTION

The object of the present invention is to overcome these disadvantages and relates to an improved spool or warp beam used in the textile industry during the warping operation. The spool of the present invention is characterized in that the outer edge of the head of each bracket is provided with a screw thread which cooperates with a screw thread provided on the peripheral edge of the cavity of the flanges, in order to allow the two components to be threadedly assembled.

According to another characteristic feature of the invention, the screw thread is such as to allow the flange to be shrunk onto the bracket.

It is another object of the present invention to provide a construction utilizing basic elements which may be joined in unique manner and arrangement to provide spools of extremely great strength.

It is another object of the present invention to provide an improved spool or warp beam that is rugged in construction, simple in assembly and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

The FIGURE is a partial, cross sectional view of one end of the spool.

DESCRIPTION OF THE PREFERRED EMBODIMENT OF THE INVENTION

Although specific terms are used in the following description for the sake of clarity, these terms are intended to refer only to the particular structure of my invention selected for illustration in the drawings, and are not intended to define or limit the scope of the invention.

Referring now to the drawings, I show a tube consisting of a tubular drum 1, which is designed with a circular cross-section and having two ends which are each provided with a screw thread 2 (only one being illustrated). The threaded portion 3 of each steel bracket 4 is threadedly engaged upon a screw thread 2 to secure the steel brackets 4 to the ends of the tubular drum 1. The brackets 4 form the joints between the drum 1 and the flanges 5 which are made of light alloy. The flanges 5 each are configured, on their outer faces, to form a circular cavity 6. Each bracket 7 is fabricated with a cooperating, configured face 11 having suitable contours to tightly engage the circular cavity 6 to hold the flanges 5 against the respective front walls 8 of the ends of the drum 1.

Each flange 5 terminates inwardly in a circular collar 12 which is formed to the same diameter as the tubular drum 1 and endwardly overfits the front wall 8 of the drum. The interaction of the cooperating face 11 of the bracket 4 against the configured outer face of the cavity 6 when the bracket threaded connection 2 is turned onto the drum 1 forces the circular collar 12 tightly against the front wall 8 in a sturdy connection.

According to the invention, the outer edge 9 of each bracket hub 7 is screw threaded as also is the outer peripheral edge 10 of each cavity 6, which serves as a seating. This combined screw threading of each bracket hub 7 and the associated flange 5 results in an intimate contact between them giving a sturdy assembly. This screw threading is dimensioned to allow, when necessary, the flange 5 to be shrunk onto the bracket head or hub 7. This shrinkage is effected by first heating the outer flange 5 which is made of light alloy, whereas the bracket itself is not heated. The outer flange expands and is then screwed onto the steel hub 7. On cooling, this outer part 5 locks onto the steel hub 7 and tends at the same time to make the contact face 11 of the bracket bear on the circular cavity 6 of the flange 5 made of light alloy.

The design of the screw threading, in accordance with this invention, enables the shrunk components to be readily dismantled for repair or replacement.

The shrinkage is such that when the temperature of the warp beam is raised to 100° C., the difference in the expansion between the bracket hub 7 and the associated light alloy flange 5 neutralizes the shrinkage. This is based on the following: Coefficient of expansion:

light alloy = 230 $^{10-7}$/0°C
steel = 120 $^{10-7}$/0°C

Since the shrinkage obtained is 0.0006 of the diameter at 10, the difference at 100°C of the diameters at the outer peripheral edge 9 of the hub 7 and outer peripheral edge 10 of the flange cavity 6 is such that the diameter of the light alloy is greater than the diameter of the steel. Thus:

$\phi$ of the light alloy at 10 (1 + 0.000023 × 100°C)
$\phi$ of the steel at 10(1 + 0.000012 × 100°C)

Difference:

$\phi$ at 10 − 0.0011.

Since the shrinkage is 0.0006 of the $\phi$ at 10, dismantling is possible, the play being 0.0005 of the diameter.

Finally, the invention makes it possible to make warp beams of great strength, withstanding both mechanical deformations of the thread as well as external shocks. Since handling and transport of the warp beam tends to expose it to blows, the method proposed by the invention gives practical results reflecting industrial progress.

Of course, the invention is not limited to the embodiment herein above described and other variants of it can be envisaged without departing from the scope of the invention.

I claim:

1. In a spool, the combination of

A. a tubular drum having a longitudinal axis,
  1. said drum having at least one end;

B. a bracket connected to the drum at the said end,
  1. said bracket extending generally angularly outwardly from the axis,
  2. said bracket including a cooperating face,
  3. said bracket terminating radially outwardly in a flange connection having an outer edge of a first diameter measured at a first temperature,
  4. said bracket having a first coefficient of expansion; and C. a flange removably affixed to the bracket,
  1. said flange extending generally angularly outwardly from the axis,
  2. said flange being provided with a bracket receiving cavity,
    a. said cavity receiving the flange connection therein,
    b. said cavity terminating radially outwardly in a peripheral edge,
  3. said flange having a second coefficient of expansion which is different from the first coefficient of expansion,
  4. the cavity peripheral edge having a second diameter measured at the first temperature,
  5. the second diameter being less than the first diameter when measured at a first temperature and the second diameter being greater than the first diameter when measured at an elevated temperature, and
  6. the outer edge of the bracket flange connection inwardly fitting within the peripheral edge of the flange cavity when the flange and bracket are heated to the elevated temperature.

2. In a spool, the combination of

A. a tubular drum having a longitudinal axis,
  1. said drum having at least one end;

B. a bracket connected to the drum at the said end,
  1. said bracket extending generally angularly outwardly from the axis,
  2. said bracket including a cooperating face,
  3. said bracket terminating radially outwardly in a flange connection having an outer edge of a first pitch diameter measured at a first temperature,
    a. the flange connection outer edge being threaded,
  4. said bracket having a first coefficient of expansion; and C. a flange removably affixed to the bracket,
  1. said flange extending generally angularly outwardly from the axis,
  2. said flange being provided with a bracket receiving cavity,
    a. said cavity receiving the flange connection therein,
    b. said cavity terminating radially outwardly in a peripherally threaded section to threadedly receive the flange connection threaded portion,
  3. said flange having a second coefficient of expansion which is different from the first coefficient of expansion,
  4. the cavity peripherally threaded section having a second pitch diameter measured at the first temperature,
  5. the second pitch diameter being less than the first pitch diameter when measured at a first temperature and the second pitch diameter being greater than the first pitch diameter when measured at an elevated temperature, and
  6. the outer edge of the bracket flange connection inwardly fitting within the peripheral edge of the flange cavity when the flange and the bracket are heated to the elevated temperature.

3. The spool of claim 2 wherein the flange cavity is provided with an outer face which is formed to the same configuration as the cooperating face of the bracket and wherein the cooperating face and the cavity outer face are maintained in intimate overall contact at both the first temperature and at the elevated temperature.

4. The spool of claim 3 wherein the bracket is fabricated of steel and the flange is fabricated of light alloy.

5. The spool of claim 4 wherein the second coefficient of expansion is substantially greater than the first coefficient of expansion.

6. The spool of claim 5 wherein the pitch diameter of the peripherally threaded section of the cavity and the pitch diameter of the outer edge of the flange connection are substantially equal when measured at a third temperature whereby the flange can be dismantled from the bracket when the parts are subjected to the third temperature.

* * * * *